US005664452A

United States Patent [19]

Engel et al.

[11] Patent Number: 5,664,452

[45] Date of Patent: Sep. 9, 1997

[54] METHOD OF ROLLING FINISHED SECTIONS FROM A PRELIMINARY SECTION IN A REVERSING ROLLING STAND ARRANGEMENT

[75] Inventors: Georg Engel, Kaarst; Dietmar Kosak, Neuss, both of Germany; Lloyd Melvin Schmelzle, Oesoto, Tex.; Michael Cygler, Colonia, N.Y.

[73] Assignee: SMS Schloemann-Siemag Aktiengesellschaft, Düsseldorf, Germany

[21] Appl. No.: 379,697

[22] Filed: Jan. 27, 1995

Related U.S. Application Data

[63] Continuation-in-part of Ser. No. 330,703, Oct. 28, 1994.

[30] Foreign Application Priority Data

Nov. 4, 1909 [DE] Germany ..... 43 37 555.3

[51] Int. Cl.[6] ..... B21B 41/06

[52] U.S. Cl. ..... 72/229; 72/225; 72/366.2; 72/206

[58] Field of Search ..... 72/224, 225, 234, 72/229, 206, 365.2, 366.2, 202, 226; 29/527.7

[56] References Cited

U.S. PATENT DOCUMENTS

| | | | |
|---|---|---|---|
| 4,791,799 | 12/1988 | Ewgel et al. | 72/229 |
| 4,860,426 | 8/1989 | Engel et al. | 72/229 |
| 5,020,354 | 6/1991 | Kosak et al. | 72/229 |
| 5,287,715 | 2/1994 | Kusaba | 72/229 |
| 5,472,041 | 12/1995 | Cryderman et al. | 29/527.7 |

FOREIGN PATENT DOCUMENTS

| | | | |
|---|---|---|---|
| 2255201 | 10/1990 | Japan | 72/229 |

*Primary Examiner*—Lowell A. Larson
*Assistant Examiner*—Ed Tolan
*Attorney, Agent, or Firm*—Friedrich Kueffner

[57] ABSTRACT

A method and a rolling stand arrangement for rolling in a reversing operation a finished section from a preliminary section produced in a continuous casting plant, wherein the preliminary section has a web-like portion corresponding to a web of the finished section and flange-like increased thickness portions corresponding to flanges of the finished section. The rolling stand arrangement includes a rolling unit in a first rolling line with a free runout and a vertical stand for acting on the flange-like increased thickness portions of the preliminary section in order to upset the web-like portion of the preliminary section. A compact rolling stand group arranged in a second rolling line includes a first universal stand on an entry side, a second universal stand on an exit side, and an edging stand arranged between the first and second universal stands. The first rolling line and the second rolling line extend parallel to one another. A transverse conveying unit is arranged following the rolling unit and immediately in front of the entry side of the compact rolling stand group for conveying the preliminary section from the first rolling line to the second rolling line.

6 Claims, 1 Drawing Sheet

METHOD OF ROLLING FINISHED SECTIONS FROM A PRELIMINARY SECTION IN A REVERSING ROLLING STAND ARRANGEMENT

CROSS-REFERENCE TO RELATED APPLICATIONS

This application is a continuation-in-part application of U.S. application Ser. No. 08/330,703 filed Oct. 28, 1994.

BACKGROUND OF THE INVENTION

1. Field of the Invention

The present invention relates to a method of rolling finished sections from a preliminary section by means of a reversing rolling stand arrangement. The rolling stand arrangement forms a compact rolling stand group which includes a first universal stand on an entry side, a second universal stand on an exit side and an edging stand arranged between the two universal stands. An edging stand is arranged in front of the compact rolling stand group. The preliminary section is a section which arrives from a continuous casting plant and has increased thickness portions at both ends of a web corresponding to the later finished section. The dimensions of the preliminary section are adapted to predetermined dimensions, such as, web height, web thickness and/or flange width, of the finished section to be rolled in such a way that the preliminary section is either introduced directly into the first universal stand of the compact rolling stand group and is then finish-rolled in the compact rolling stand group into the finished section having the predetermined dimensions, or, prior to the introduction of the preliminary section into the first universal stand of the compact rolling stand group, the preliminary section is subjected to a reducing rolling in a rolling unit arranged immediately in front of the compact rolling stand group in order to achieve different dimensions deviating from the original determination of the web height, web thickness and/or flange width of the finished section to be finish-rolled in the compact rolling stand group.

2. Description of the Related Art

Starting from the finding that a preliminary section arriving from a continuous casting plant and directly introduced into the compact rolling stand group only permits a limited number of finished sections of different dimensions to be rolled from the preliminary section, it has already been proposed in EP-A-265 757 to roll finished sections with significantly larger final dimension differences from a single unchanged initial continuously cast section in one and the same compact rolling stand group by subjecting the preliminary section to a reducing rolling in an edging stand arranged immediately in front of the compact rolling stand group, for example, by acting on the web-like portion or the flange-like increased thickness portions of the preliminary section, and subsequently introducing the preliminary section into the compact rolling stand group. This made it possible to either shorten the web-like portion of the preliminary section by upsetting or edging, or to increase the web-like portion possibly with the inclusion of flowable increased thickness portions, and also to reduce the width of the flange-like increased thickness portions. In this known method, the compact rolling stand group immediately following the edging stand could be partially utilized for the reducing deformation of the preliminary section, for example, for acting on and shaping the flanges of this preliminary section.

When the known method was carried out it was found to have the disadvantage that the compact rolling stand group was not available for a finish rolling procedure during the reducing rolling of the preliminary section, so that the total output of the plant achievable with the method was limited.

SUMMARY OF THE INVENTION

Therefore, it is the primary object of the present invention to improve the above-described known method in such a way that significantly greater outputs and better unit capacity factors can be achieved.

In accordance with the present invention, the reducing rolling of the preliminary section is carried out in a rolling line with free runout extending parallel to the rolling line of the compact rolling stand group, and the reduced preliminary section is transversely displaced into a position immediately in front of the compact rolling stand group and is introduced into the compact rolling stand group.

This method of operation makes it possible that the reducing rolling of the preliminary section can be carried out independently of the work of the compact rolling stand group. In other words, the reduced preliminary section can be rolled into the finished section in the compact rolling stand group while the reducing rolling of the next preliminary section already takes place in the parallel rolling line.

For carrying out the method according to the present invention, a rolling unit may be arranged in the parallel rolling line which includes a vertical stand for acting on the flange-like increased thickness portions of the preliminary section so as to upset the web-like portion of the preliminary section.

In accordance with another feature, a horizontal stand for acting on the web-like portion of the preliminary section may be added to the vertical stand. However, it is also possible to arrange only one such horizontal stand in the parallel rolling line and to add a universal stand to this horizontal stand, wherein the universal stand is capable of acting on the flange-like increased thickness portions as well as on the web-like portion of the preliminary section.

In accordance with another feature of the invention, the rolling line may include a reversing two-high roughing stand as a vertical stand or horizontal stand with preferably smooth rolls, wherein a turning device for the sectional strand is arranged following the two-high roughing stand. This arrangement makes it possible to act in a rolling stand optionally on the web-like portion or on the flange-like increased thickness portions of the preliminary section so as to upset the web-like portion, and to turn the sectional strand by means of the turning device after the sectional strand passes through the roughing stand and, subsequently, to subject the sectional strand in a reversing operation to another pass; if necessary, repeated passes may be carried out.

In a rolling stand arrangement which includes a heating furnace arranged following the continuous casting plant and in front of the first rolling line, the present invention provides that a horizontal rolling stand may be arranged in front of the heating furnace, wherein the horizontal rolling stand carries out roughing or breaking down, particularly of the flange-like increased thickness portions of the preliminary section which is hot from casting. This arrangement makes it possible to subject the sectional strand immediately following the continuous casting plant to a roughing or breaking down deformation while it is still hot from casting, in order to already reduce especially the volume of the flange-like increased thickness portions of the preliminary section before it enters the heating furnace, so that a better utilization of the heating furnace is possible and an equalization of the temperature distribution across the cross-section of the section is achieved.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF TEE PREFERRED EMBODIMENTS

Figure 1:
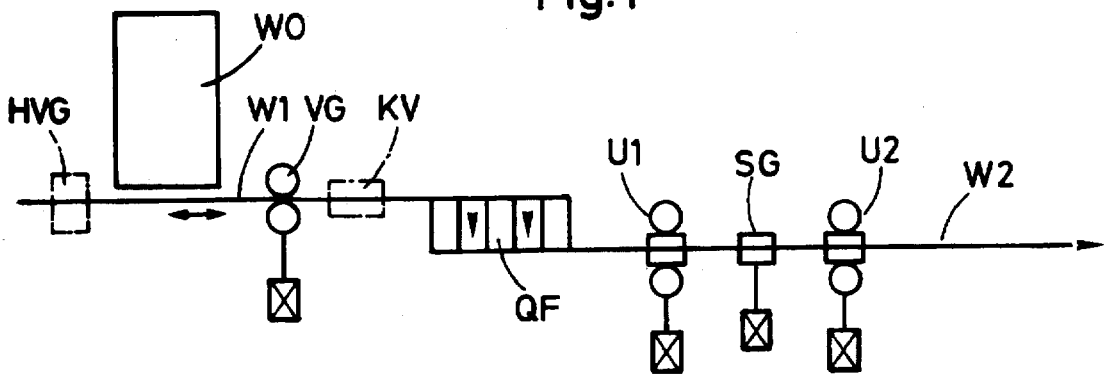
FIG. 1 is a schematic top view of a rolling train according to the present invention.

As illustrated in FIG. 1 of the drawing, a vertical stand VG is arranged in a rolling line W1. Arranged in a rolling line W2 extending parallel to the rolling line W1 is the compact rolling stand group which is composed of the universal rolling stands U1 and U2 and an edging stand SG arranged between the stands U1 and U2. A transverse conveying unit QF is arranged between the two rolling lines W1 and W2. The continuously cast preliminary sections, not shown, arriving from the heating furnace W0 arranged in the rolling line W1 are upset in the vertical stand VG with respect to the web height thereof to such an extent that the length of the web between the opposing inner surfaces of the flanges of the preliminary section is adjusted to the corresponding dimension of the universal stands U1 and U2 of the compact rolling stand group in the parallel rolling line W2. Practical experiments have shown that it is possible, for example, to upset the web height by 60 mm per pass in the vertical stand VG and that the web height can be reduced by 300 mm in only five passes. The vertical stand VG requires only one groove and the resulting short rolling lengths make possible short distances between the vertical stand VG and the first universal rolling stand U1 of the compact rolling stand group U1, SG, U2.

Figure 2:
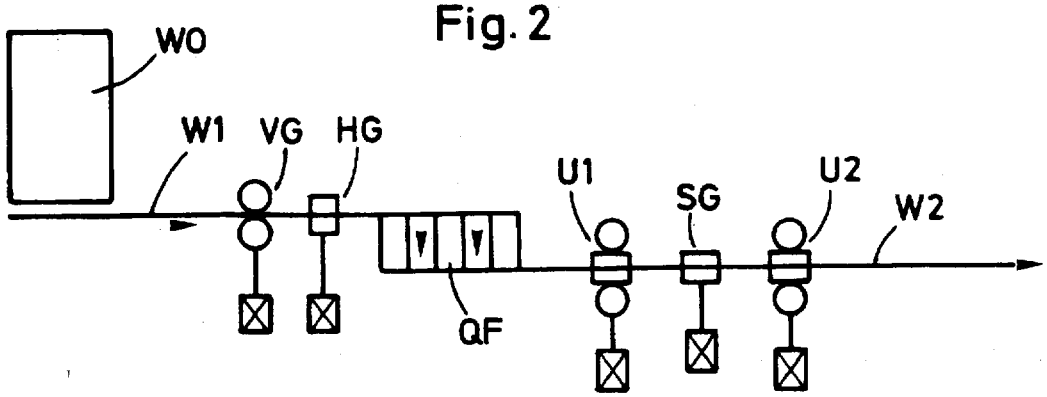
FIG. 2 is a schematic top view of another embodiment of the rolling train.

The arrangement of the rolling lines W1 and W2 in FIG. 2 is the same as in FIG. 1. The compact rolling stand group U1, SG, U2 and the transverse conveyor QF are also the same. However, in FIG. 2, a horizontal stand HG is arranged following the vertical stand VG in the rolling line W1. This horizontal stand HG makes it additionally possible to act on the web-like portion of the preliminary section and, thus, to obtain a more favorable web/flange ratio of the preliminary section for entering the compact rolling stand group U1, SG, U2. Since it is possible in this case to reduce the height of the flange-like increased thickness portions of the preliminary section in the last pass, the reduction in the compact rolling stand group by means of the edging stand SG can be dimensioned smaller and, thus, the corresponding engine power can also be reduced.

As also illustrated in FIG. 1, in an arrangement in which the vertical stand VG is a two-high stand as a reversing vertical or horizontal stand with preferably smooth rolls, a turning device KV indicated in dash-dot lines can be arranged following the stand VG, wherein, as described above, the sectional strand emerging from the vertical stand VG can be turned and subsequently subjected in a reversing operation to another pass through the vertical stand VG.

As additionally illustrated in FIG. 1, a horizontal roughing stand HVG, also illustrated in dash-dot lines, can be arranged in front of the heating furnace W0, wherein, in the manner already described above, the sectional strand which arrives from the continuous casting plant, not shown, and is still hot from casting, is preshaped in the horizontal roughing stand HVG.

The invention is not limited by the embodiments described above which are presented as examples only but can be modified in various ways within the scope of protection defined by the appended patent claims.

I claim:

1. A method of rolling finished sections from a preliminary section in a reversing rolling stand arrangement, the rolling stand arrangement including a compact rolling stand group with a first universal stand on an entry side, a second universal stand on an exit side and a first edging stand arranged between the first and second universal stands, a second edging stand being arranged in front of the entry side of the compact rolling stand group, the preliminary section being a section arriving from a continuous casting plant and having increased thickness portions at both ends of a web corresponding to the finished section, the method including, depending on at least one predetermined dimension including web height, web thickness and flange width, of the finished section to be rolled, introducing the preliminary section one of directly into the first universal stand of the compact rolling stand group and subsequently finish-rolling the section in the compact rolling stand group into the finished section having the predetermined dimensions, and, prior to introducing the preliminary section into the first universal stand of the compact rolling stand group, subjecting the preliminary section to a reducing rolling in a rolling unit arranged immediately in front of the compact rolling stand group in order to achieve different dimensions deviating from an original determination of the at least one dimension including web height, web thickness and flange width of the finished section to be finish-rolled in the compact rolling stand group, the improvement comprising carrying out the reducing rolling of the preliminary section in a rolling line with free runout extending parallel to a rolling line of the compact rolling stand group, transversely displacing the preliminary section from the rolling line with free runout into a position immediately in front of the compact rolling stand group, and subsequently introducing the preliminary section into the compact rolling stand group.

2. A reversing rolling stand arrangement for rolling a finished section from a preliminary section produced in a continuous casting plant, the preliminary section having a web-like portion corresponding to a web of the finished section and flange-like increased thickness portions corresponding to flanges of the finished section, the rolling stand arrangement comprising a rolling unit with a free runout arranged in a first rolling line, the rolling unit comprising a vertical stand for acting on the flange-like increased thickness portions of the preliminary section in order to upset the web-like portion of the preliminary section, further comprising a compact rolling stand group arranged in a second rolling line, the compact rolling stand group comprising a first universal stand on an entry side, a second universal stand on an exit side, and an edging stand arranged between the first and second universal stands, the first rolling line and the second rolling line extending parallel to one another, further comprising a transverse conveying unit arranged following the rolling unit and immediately in front of the entry side of the compact rolling stand group for conveying the preliminary section from the first rolling line to the second rolling line.

3. The arrangement according to claim 2, wherein the first rolling line further comprises a horizontal stand for acting on the web-like portion of the preliminary section.

4. The arrangement according to claim 2, wherein the first rolling line further comprises a reversing two-high stand as a horizontal stand with smooth rolls, and a turning device for turning the section arranged following the reversing two-high stand.

5. The arrangement according to claim 2, wherein the first rolling line further comprises a reversing two-high stand as a vertical stand with smooth rolls, and a turning device for turning the section arranged following the reversing two-high stand.

6. The arrangement according to claim 2, further comprising a heating furnace arranged following the continuous casting plant and in front of the first rolling line, a horizontal rolling stand for acting on the flange-like increased thickness portions of the preliminary section being arranged in front of the heating furnace.

* * * * *